US005170833A

United States Patent [19]

Taylor et al.

[11] Patent Number: 5,170,833

[45] Date of Patent: Dec. 15, 1992

[54] COMPENSATING MECHANISM FOR VARIABLE SPEED ROLL-UP DOOR

[75] Inventors: Douglas B. Taylor, Barrie; Craig Jerry, Beeton, both of Canada

[73] Assignee: M & I Door Systems Limited, Barrie, Canada

[21] Appl. No.: 706,945

[22] Filed: May 29, 1991

[30] Foreign Application Priority Data

Mar. 22, 1991 [CA] Canada ..... 2038862

[51] Int. Cl.[5] ..... E06B 9/68

[52] U.S. Cl. ..... 160/310; 160/265

[58] Field of Search ..... 160/310, 265, 133, 321, 160/322; 242/67.5, 75.1

[56] References Cited

U.S. PATENT DOCUMENTS

| | | | |
|---|---|---|---|
| 490,448 | 1/1893 | Lugrin . | |
| 929,742 | 8/1909 | Wilson . | |
| 1,121,898 | 12/1914 | Davis | 160/265 |
| 3,460,602 | 8/1969 | Hugus . | |
| 3,490,514 | 1/1970 | Duncan et al. . | |
| 3,878,879 | 4/1975 | Manns | 160/133 X |
| 4,252,172 | 2/1981 | Buffet et al. . | |
| 4,478,268 | 10/1984 | Palmer . | |
| 4,690,194 | 9/1987 | Seuster . | |
| 4,690,195 | 9/1987 | Taylor . | |
| 4,887,660 | 12/1989 | Kraus . | |
| 4,976,302 | 12/1990 | Taylor . | |
| 4,997,022 | 3/1991 | Klein . | |
| 5,048,588 | 9/1991 | Weishar et al. | 160/310 X |

*Primary Examiner*—David M. Purol

*Attorney, Agent, or Firm*—Kramer, Brufsky & Cifelli

[57] ABSTRACT

A rolling door assembly including a flexible curtain having an inner end, an outer end and side edges. The inner end of this curtain is mounted to a rotatable curtain roll. The assembly includes a sprocket mounted on the curtain roll and a continuous chain loop that extends around this sprocket and is connected to a motor drive to form a curtain winding and unwinding mechanism. Two drive loop members are in operable engagement with the curtain roll for purposes of loop travel during rotation of the roll. The bottom end of the curtain is secured to the two drive members so that the bottom end and the drive loop members travel together. There are also two adjusting mechanisms connected between the bottom end of the curtain and the two loop members to accommodate a difference in speed of travel between the loop members and the bottom end of the curtain, the latter moving at a variable speed as the curtain is wound or unwound.

16 Claims, 5 Drawing Sheets

COMPENSATING MECHANISM FOR VARIABLE SPEED ROLL-UP DOOR

BACKGROUND OF THE INVENTION

This invention relates to rolling door assemblies and in particular such assemblies wherein the rolling door comprises a flexible curtain connected at the top or inner end to a rotatable curtain roll.

The use of rolling doors, particularly for industrial and commercial applications, is well known. These doors can be of various constructions including flexible doors made from relatively thin plastic or fabric sheets. Generally the door is rolled up about a horizontal roll or shaft extending across the top of the door opening. In some cases the roll for the curtain can be spring loaded in order to counter balance the door and overcome gravitational forces acting on the door so it will open with relative ease. It is common to provide an electric operator including an electric motor to open and close the door. Generally this operator rotates the curtain roll at a constant rate of speed. Vertical guide channels are generally provided along the sides of the doorway to accommodate the edges of the flexible door.

U.S. Pat. No. 4,690,195, issued Sep. 1, 1987 to Douglas B. Taylor teaches an operating mechanism for a rolling door having power operated means for rolling up and rolling down the door. In one version there is a drive gear for the door shaft which supports the rolling door and a further drive gear for a idler shaft which helps to feed the flexible rubber curtain into its guide channels. These drive gears are floatingly mounted on the respective shafts for free rotation. By means of a dog and pin arrangement, means are provided for accommodating excess winding and unwinding forces which develop in this system as a result of a variation in the actual linear velocity of travel of the bottom or outer end portion of the curtain during unwinding and winding operations. This variation in linear velocity arises from the variation in the diameter of the windings of the rolled door on the door shaft as it is rotated while the speed of rotation of the door shaft itself is constant. There are several difficulties with this known arrangement including the need for an idler roll and the need to precisely locate the dog member and pin associated with each shaft to ensure that engagement and positive drive only occur at the appropriate times.

A simpler arrangement for accommodating the variation in speed of a roll up door is disclosed in copending Canadian patent application Ser. No. 554,847 filed Dec. 18, 1987 by the present applicant. In this known arrangement, there is an idler drive member supported about the idler or guide roll of the roll door assembly. An adjusting element including a coil spring is provided and is capable of accommodating the differences in the turning forces developed at the idler drive member and at the idler or guide roll. This adjusting element is connected between the idler drive member and the idler or guide roll.

While this known arrangement may be suitable for thicker flexible curtains which generally require the use of an idler roll in order to feed the curtain into its guide channels, it is not entirely suitable for other applications and has some disadvantages. For example many rolling door assemblies now in the market employ thin flexible curtains have a thickness of about ⅛' and such curtains often do not require the use of an idler roll. Because the curtain is quite thin, the diameter of the rolled curtain is not necessarily substantial. The variation in the diameter of the rolled curtain that does occur as the curtain is unwound can generally be accommodated by the construction of the guide channels and the location of the door roll above the door opening. Also the operating life of the coil spring which forms the adjusting element in this known rolling door assembly is somewhat limited because the load or forces acting on the spring can be quite substantial. Further if the rolling door becomes disconnected from the two chain loop members that act to pull this rolling door downwards, due to an impact on the door or otherwise, it can require considerable time and skill to restore this rolling door assembly to proper working order.

It is an object of the present invention to provide a rolling door assembly that includes a flexible curtain mounted on a rotatable curtain roll and that has a simple and easy to construct adjusting mechanism that is connected between the outer or bottom end of the curtain and a drive mechanism for pulling the flexible curtain downwards. This adjusting mechanism accommodates a difference in speed of travel between the drive mechanism and the outer or bottom end of the curtain, the outer end moving at a variable speed as the curtain is wound up or unwound.

The preferred adjusting mechanism described and illustrated herein has a good operating lifetime and it avoids the need for counterbalance springs or counterweights often used in the past to ensure that a rolling door remains fully closed in the closed position.

A further advantage of the preferred rolling door assembly described herein is that, should the rolling door accidentally become detached from its drive mechanism due to an impact on the door or otherwise, it is a relatively quick and easy operation to reconnect the door curtain so that the door assembly is back in working order.

SUMMARY OF THE INVENTION

According to one aspect of the invention, a rolling door assembly comprises a flexible curtain having an inner end, an outer end and side edges, a curtain winding and unwinding mechanism, and a rotatable curtain roll, an inner end of the curtain being mounted to the curtain roll. The curtain mechanism comprises a curtain sprocket mounted to the curtain roll and primary drive means to rotatinqly drive the curtain sprooket. There is also secondary drive means operatively connected to the outer end of the curtain for travel therewith and operatively connected to the curtain roll so as to be driven thereby. Further there is an adjusting mechanism connected between the outer end of the curtain and the secondary drive to accommodate a difference of speed of travel between the secondary drive and the outer or bottom endof the curtain. It will be understood that the outer end of the curtain moves at a variable speed as the curtain is wound up or unwound.

The preferred adjusting mechanism includes a coil spring arranged vertically in a tubular housing. In a preferred embodiment, the tubular housing is circular in cross-section, but it will be obvious to those skilled in the art that tubes with other cross-sections, such as a square tube, may be employed. This coil spring is compressed to accommodate the difference in speed of travel as the curtain is unwound and the spring expands as the curtain is wound up.

According to another aspect of the invention, a rolling door assembly comprises a flexible curtain having an inner end, a outer end and side edges, a curtain winding and unwinding mechanism and a rotatable curtain roll, the inner end of the curtain being mounted on this roll and the Winding and unwinding mechanism being connected to the roll. There are also means connected to the outer or bottom end of the curtain and to the curtain roll for maintaining a tensile force on the curtain in the lengthwise direction thereof as the curtain is wound up or unwound. The maintaining mechanism moves in the vertical direction during the opening or closing of the door. An adjusting mechanism is connected between the outer end of the curtain and the maintaining mechanism to accommodate a difference in speed of movement between the maintaining mechanism and the outer end of the curtain.

Further features and advantages will become apparent for the following detailed description taken in conjunction with the accompanying drawings.

DETAILED DESCRIPTION OF PREFERRED EMBODIMENT

Figure 1:
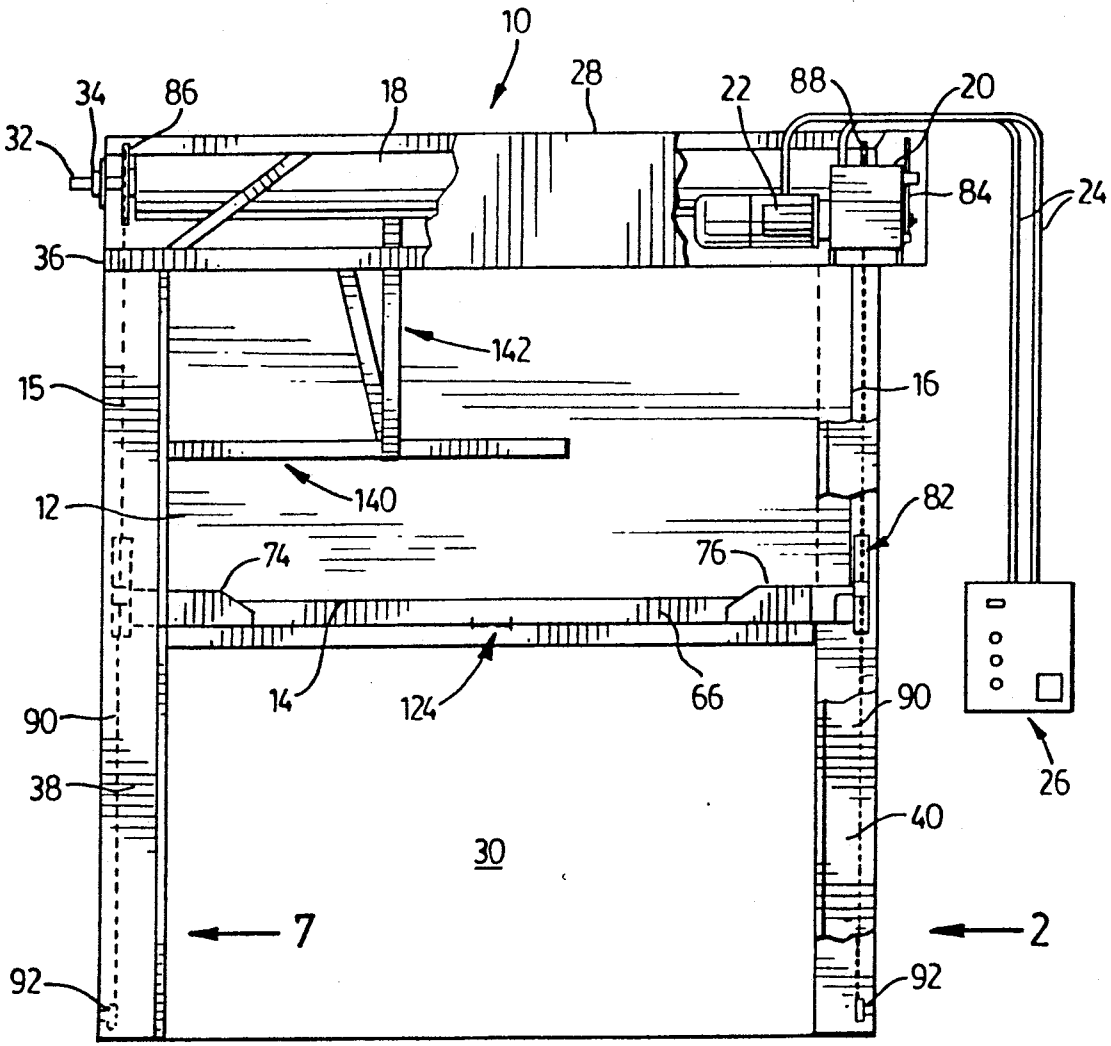
FIG. 1 is a front elevation of a rolling door assembly constructed in accordance with the invention with the front guide plate on the right side partly broken away for clarity of illustration and only a portion of the hood at the top of the door being shown, again for clarity.

A rolling door assembly 10 constructed in accordance with the invention includes a flexible curtain 12 having an inner or top end, an outer or bottom end 14, and two side edges 15 and 16. The top end of the curtain is mounted to a rotatable curtain roll 18 in a well known manner. There is a curtain winding and unwinding mechanism in the form of an electric door operator 20. The operator includes an electric motor 22. Electrical lines 24 connect the electric door operator to a wall mounted control panel 26 of known construction. In order to improve the appearance of the assembly, the door roll 18 can be partially or wholly enclosed by a hood 28, only partially shown in FIG. 1.

The door is rolled around the horizontal roll 18 that extends across the top of the door opening 30. In a known manner, the roll 18 has a shaft section 32 projecting outwardly from each end, each section being rotatably mounted in a suitable bearing 34 mounted on a support bracket 36. In a preferred embodiment the roll 18 is in the form of a spring loaded barrel of known construction (see for example U.S. Pat. No. 4,478,268). Briefly, torsion springs are mounted inside the roll 18 at one end and these help to wind up the door by counterbalancing the gravitational forces acting on the door.

Figure 2:
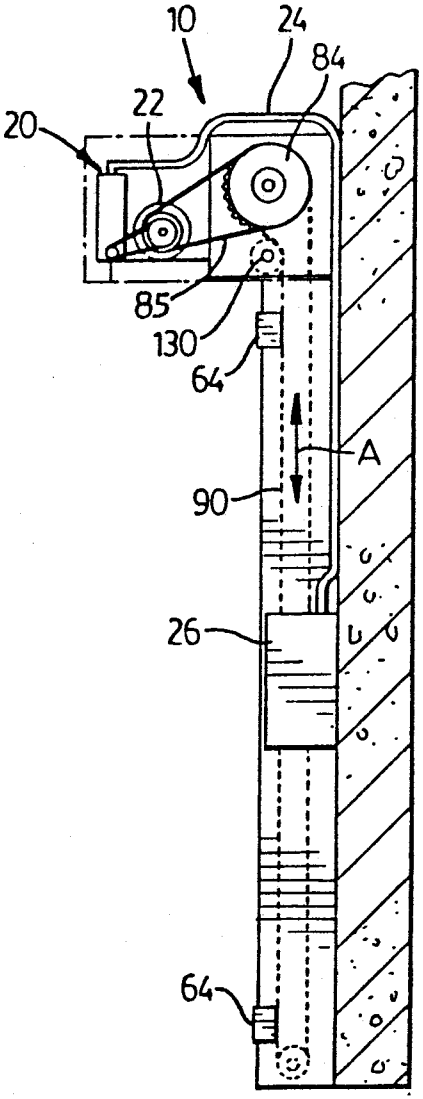
FIG. 2 is a side elevation of the door assembly of FIG. 1.
Figure 3:
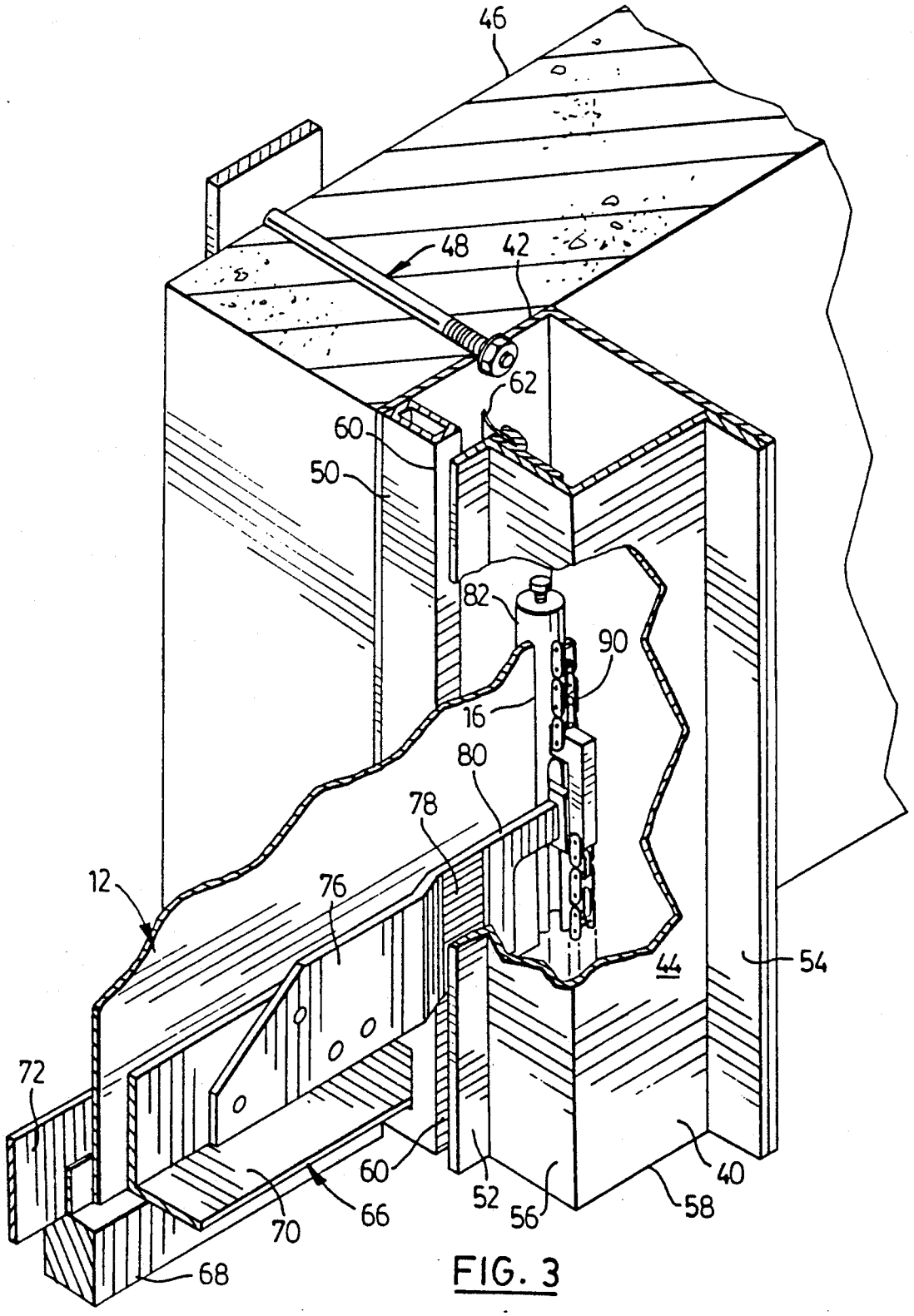
FIG. 3 is an enlarged cut-way view of part of the bottom bar assembly and the mechanism for connecting one end of the bottom bar to an endless drive chain arranged in the guide channel for the door.

In a preferred form of rolling door, vertical guide channels 38 and 40 are arranged on opposite sides of the door opening 30, these acting to guide the flexible curtain along the correct path. Each of these guide channels is constructed in essentially the same manner and therefore reference will be made herein to the guide channel 40 the construction of which can be seen clearly from FIG. 3. Each guide channel is constructed of two guide plates 42 and 44 which are preferably made of steel or aluminum. The rear guide plate 42 is connected to the adjoining wall 46 of the structure such as by mounting bolts, one of which is shown at 48. The rear guide plate 42 is generally L shaped in cross section but has a tubular member 50 of rectangular cross section rigidly affixed thereto and extending along its inner edge. The front guide plate 44 has three right angle bends extending in the lengthwise direction, thus forming an inner flange section 52, an outer flange section 54 that is connected to the rear guide plate and two wider intermediate sections 56 and 58. Formed between the inner flange section 52 and the tubular member 50 is an elongate slot or gap 60 in which the respective side edge of the curtain runs up and down. If desired, a guide sealing strip 62 can be mounted on the front guide plate as shown in FIG. 3 in order to create a wind seal with the edge of the curtain. Also, if desired all or a portion of the front guide plate can be hingedly mounted in a known manner such that the hinged portion can be swung away from the position shown in FIG. 3 for purposes of repair or maintenance. Two guide hinges 64 for this purpose are illustrated in FIG. 2.

Figure 6:
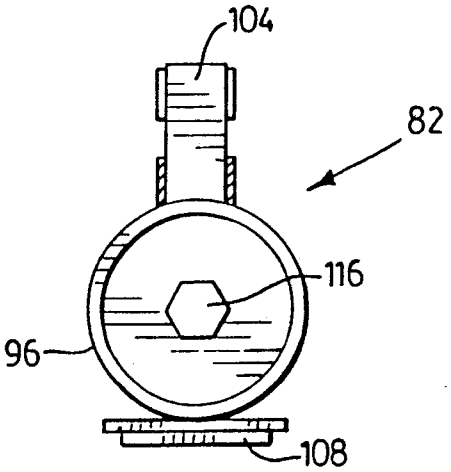
FIG. 6 is a top end view of the adjusting mechanism of FIG. 4, this figure being shown on the same sheet as FIG. 2.

The flexible rolling door is provided with a rigid bottom bar 66. This bottom bar extends the width of the door opening and into the guide channels. The illustrated bottom bar of FIG. 3 has arranged along its bottom a safety edge device 68 of known construction. If this safety edge strikes an object or vehicle as the door is closing, it will automatically cause the door to reverse direction and to begin winding up or, alternatively, it will simply cause the door to stop movement in the downwards direction. The illustrated bar 66 includes angle member 70 and plate member 72 and between these two members the bottom of the flexible curtain 12 can be clamped. By bolts (not shown), the angle number 70 is connected to two end plates 74 and 76 of similar construction. The end plate 76 is shown in detail in FIG. 3. The end plate is formed with a slight double bend in its central region and it extends through the slot or gap 60 formed by the adjacent guide channel. Preferably a portion of the inside surface of the end plate located in the slot or gap is covered with a friction reducing material indicated at 78. This material can be ultrahigh molecular weight (hereinafter referred to as UHMW) plastic. These anti-friction plastic plates help to reduce friction between the end plate and the flange 52 of the guide plate, particularly when wind forces are acting to push the flexible curtain inwardly. Each of the end plates also has a outwardly extending finger 80 releasably connected to an adjusting means or adjusting mechanism indicated generally at 82 and described in detail hereinafter with particular reference to FIGS. 4 to 6.

Connected to the shaft at one end of the roll 18 and rotatable therewith is a curtain sprocket 84. Extending around this sprocket and driving same is a chain loop 85. This chain loop is driven by the aforementioned electric door operator 20. The operator is capable of rotating the sprocket 84 in either direction in order to wind or unwind the rolling door.

Figure 7:
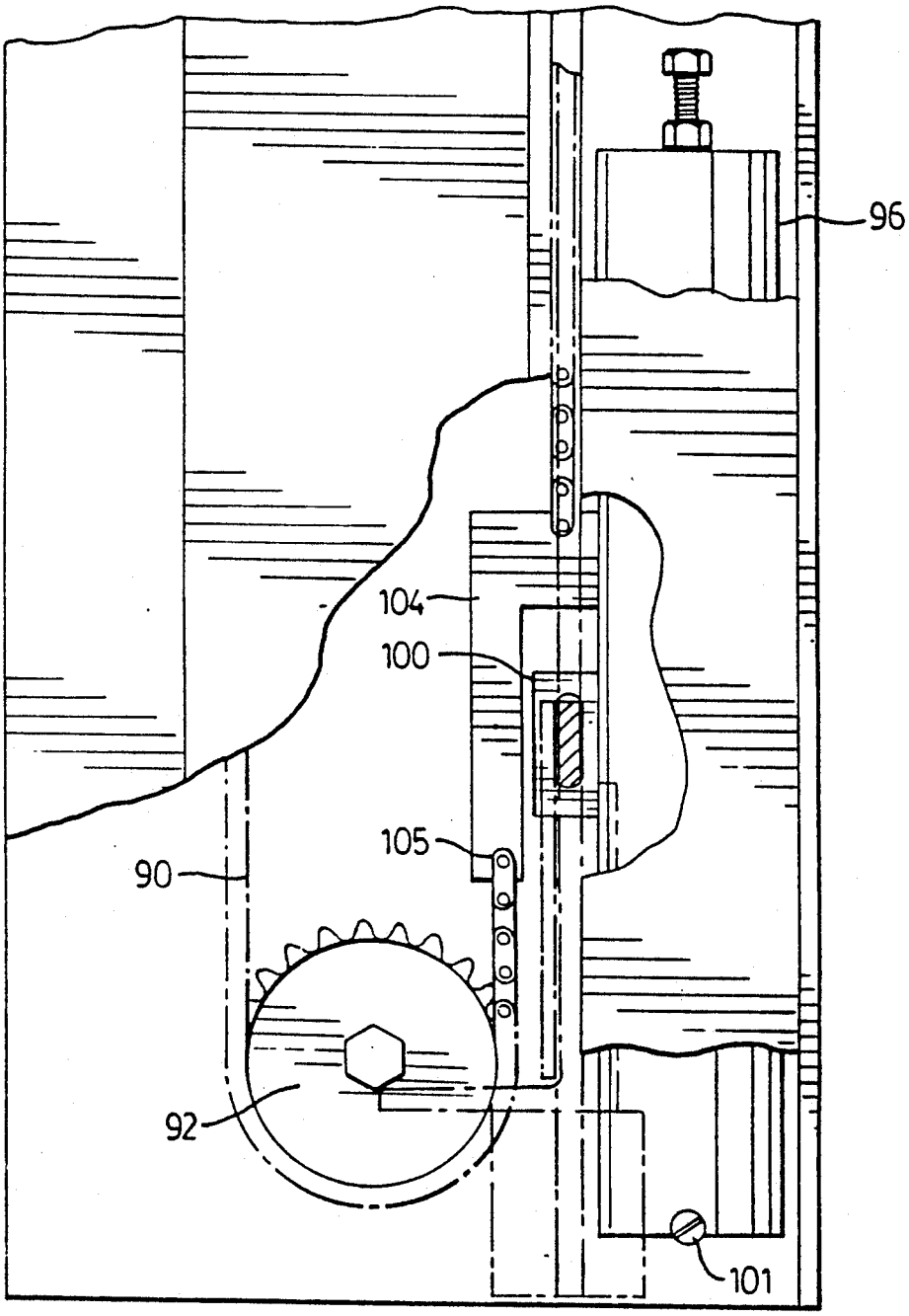
FIG. 7 is a side view of the bottom portion of the door assembly showing the adjusting mechanism in its lowermost position.

Mounted on both of the shafts extending from opposite ends of the door roll are two further chain sprockets 86 and 88. These sprookets have a diameter which is approximately equal to the diameter of the flexible curtain 12 when it is rolled up to its maximum extent. Extending around each of these chain sprockets 86, 88 is a drive loop member 90. It will be appreciated that each of these drive loop members is thus in operable engagement with the door shaft for loop travel during rotation of the door shaft and door roll 18. As can be seen from FIG. 1 each of the drive loops members 90 is located adjacent a respective side edge of the flexible curtain, being spaced outwardly therefrom a short distance. At the bottom end each loop member 90 extends around an idler sprocket 92. As shown clearly in FIG. 7, each sprocket 92 is rotatably mounted close to the floor forming the bottom of the door opening.

To permit the tightness of the loop member 90 to be adjusted, the position of the sprocket is preferably made adjustable in a known manner.

It will be appreciated that each loop member 90 is operatively connected to the curtain roll 18 and its end shafts so as to be driven thereby. As explained more fully hereinafter, the bottom of the flexible curtain via the bottom bar is connected to each of these drive loop members 90. These loop members advantageously act as a means for maintaining a tensile force on the flexible curtain in the lengthwise direction of the curtain as the curtain is wound up or unwound. Thus these drive loop members 90 help to keep the curtain tight at all times, prevent the possibility of the flexible curtain jamming in the narrow slots formed by the guideways, and help to maintain the side edges of the curtain in the guideways. It will be understood that the straight sections of each drive loop member 90 move in the vertical direction as indicated by the arrow A in FIG. 2 during the opening and closing of the door. This movement of these straight portions is at a constant rate of speed assuming that the motor 22 is rotating the sprockets 86, 88 at a constant rate of speed.

The difficulty with the described means for winding an unwinding the flexible curtain 12 is that although the straight portions of the drive members 90 move at a constant rate of speed, the outer end or bottom end of the curtain moves at a variable speed as the curtain is wound or unwound. This is due t the fact that the speed of the outer end depends to some extent on the diameter of the rolled portion of the door, which diameter changes as the door is wound up or unwound. Problems can arise in the operation of flexible curtains of this type unless some mechanism or device is provided for accommodating this difference in speed of movement. The present invention provides a simple, easy to construct and reliable adjusting mechanism.

Figure 4:
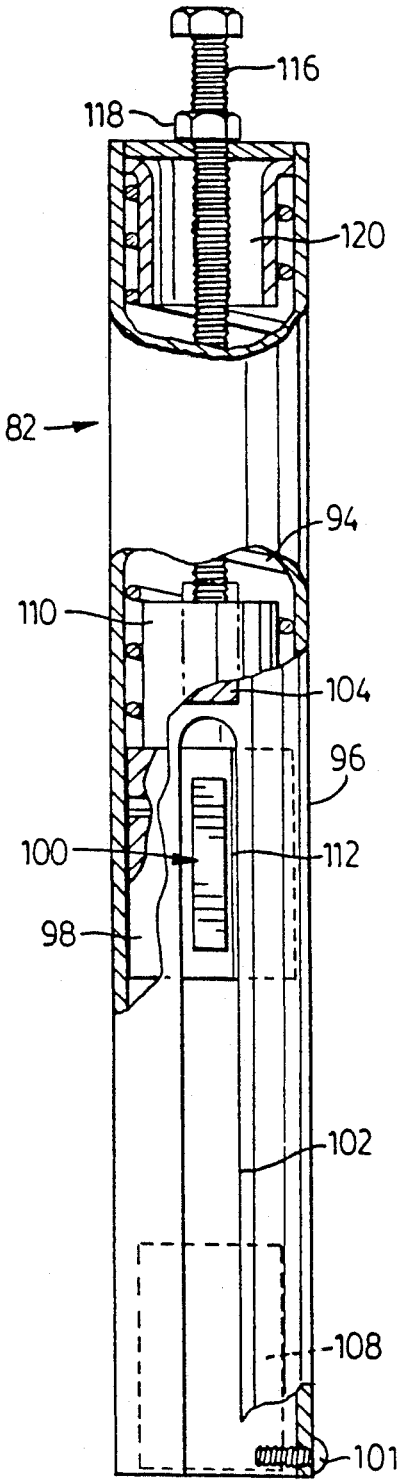
FIG. 4 is a front elevation partly broken away and in section along the line 4—4 of FIG. 5, of an adjusting mechanism constructed in accordance with the invention with its coil spring fully compressed.
Figure 5:
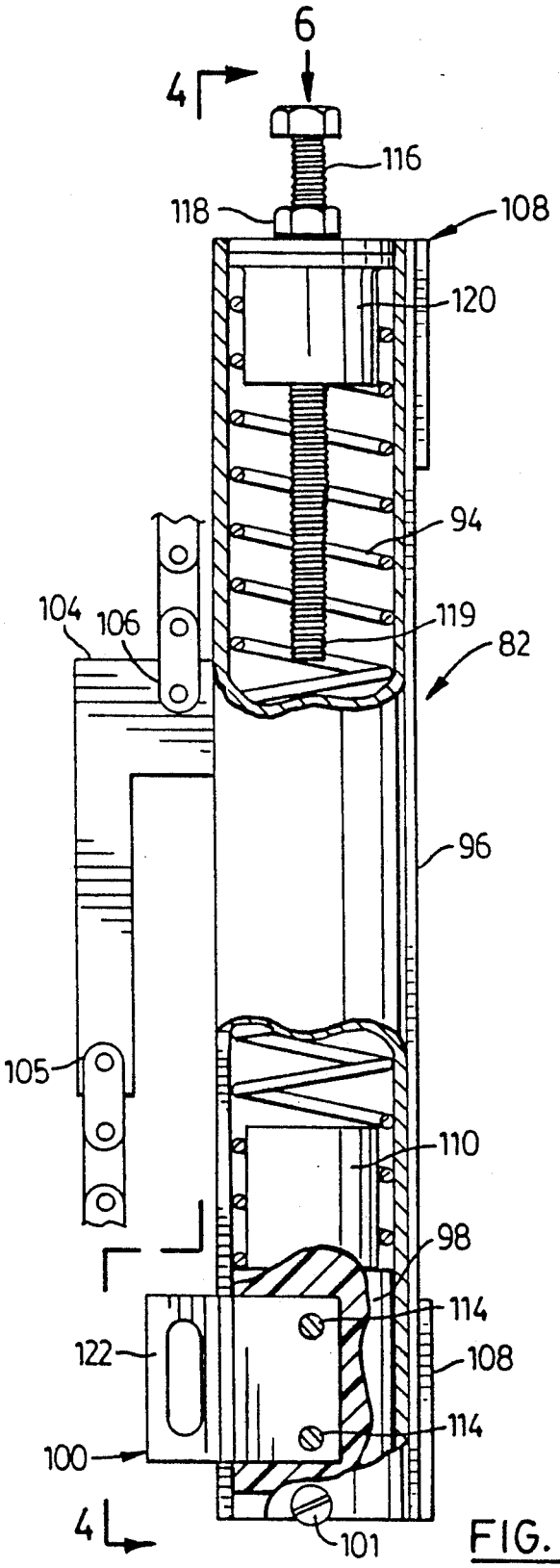
FIG. 5 is a side elevation, partly broken away, showing the adjusting mechanism with the coil spring fully expanded.

In the preferred illustrated embodiment, there are two adjusting means or adjusting mechanisms, one arranged in each of the guide channels. Each adjusting mechanism is connected between the outer or bottom end of curtain 12 and the respective drive loop member 90. The two adjusting mechanisms are of identical construction and the preferred version is illustrated in detail in FIGS. 4 to 6. Each mechanism includes a compression spring 94. This spring 94 is compressed to accommodate the difference in speed of travel as the curtain is unwound and it expands as the curtain is wound up. FIG. 5 illustrates the position of the coil spring when the flexible door is fully rolled up while FIG. 4 illustrates the coil spring when the curtain has been lowered completely. The adjusting mechanism includes a tubular housing 96 which is closed at the top end and open at the bottom end. A piston member 98 is slidable in the housing 96 and engages one end of the coil spring. A screen, 101 at the bottom end of the housing 96 keeps the piston member in the housing. This piston member has a connecting tab 100 extending outwardly therefrom and through an elongate slot 102 formed in the housing. The outer end of the curtain is connected to the tab 100 by means of the aforementioned finger 80 that extends outwardly from the bottom bar. Extending outwardly from a central portion of the housing 96 is a hook member 104. The member 104 is provided with two pin holes 105 and 106 and these are used to connect the adjusting mechanism to its drive loop member 90 by means of suitable connecting pins (see FIG. 7 of the drawings). Also rigidly fixed to the outside of the housing 96 are two UHMW pads 108 to reduce any friction between this side of the housing and the guide channels as the mechanism is moved up and down in the channel.

Turning now to the construction of the piston member 98, preferably this member is formed with a cylindrical upward extension 110 having a smaller diameter than the main portion of the piston member. The extension 110 helps to centre the end of the coil spring and to keep the spring straight in the housing. The piston member is preferably made from high impact plastics material which again helps to reduce the frictionbetween it and the inside of the housing. A slot 112 is machined into the piston member to snugly and firmly receive the steel connecting tab 100 which is secured in place by two steel spring pins indicated at 114 in FIG. 5. These pins 114 are driven into drilled holes in the piston member and, in a known manner, they expand against the sides of these holes.

If desired, the maximum upward movement of the piston member 98 can be controlled by a long adjustable bolt 116 which extends through a threaded opening in the top of the housing 96. By adjusting the position of the bottom end 118 of this bolt, one can thereby limit the maximum upward movement of the piston member in the housing. This is highly advantageous since it permits one to carefully control the distance the fully lowered flexible curtain can be raised above the floor by external means such as by lifting up the bottom bar. The bolt 116 can also prevent the bottom of the door from being raised by simple wind load on the flexible curtain. This can help avoid substantial heat loss and drafts when the door is exposed to windy conditions. Also because the bolts 116 are so easily adjusted and can be adjusted after the rolling door assembly has been installed in its respective door opening, the use of this device makes the installation of applicant's door simpler. Once each bolt has been threaded into the housing to the correct position, this position can be secured by tightening a nut 118 so that it rests firmly against the top of the housing.

Another preferred feature of the housing 96 is the provision of a spring seat 120 on the inside of the housing at the top end. This seat which is preferably made of bronze and is cylindrical in shape helps to keep the coil spring straight in the vertical direction and helps to increase the life of the spring.

It should be noted that in the preferred embodiment the bottom bar of the door is releasably connected by the attaching means or fingers 80 to the piston member 98. This is highly advantageous since, if the flexible curtain is struck by a vehicle or other object, the bottom bar is able to bend or otherwise come out of the guide channels. The finger 80 simply slides out of the slot 122 in the tab 100. In this way the adjusting mechanisms, the guide channels and the drive loop 90 will not be damaged by the impact on the curtain. To facilitate the release of the bottom bar from the guide channels, the bottom bar can be provided with a breakaway device 124 at its centre. The construction of this device is known in this art and need not be described in detail herein.

The adjusting mechanisms 82 described herein are ideal for relatively thin flexible curtains. With thin curtains, the variation in speed of the bottom end of the curtain as it travels up and down is not as great as for doors comprising a thick curtain. In a preferred embodiment of the present rolling door assembly, the curtain is made of a thin, strong fabric material having a maximum thickness of no greater than ¼" and preferably no greater than ⅛". Because the variation in speed of the bottom end of the door is not great, the amount of travel of the piston member 98 and the size of the housing 96 and coil spring 94 need not be unduly large. The curtain can also be made of thin flexible vinyl sheet.

In the illustrated preferred embodiment, there is an idler sprocket 130 provided for each of the drive loop members 90. Each sprocket 130 is located directly below the respective one of the chain sprockets 86, 88. These sprockets 130 help to feed the loop members 90 into their respective guide channels. The sprockets 130 are not required if the guide channels themselves are configured so that the chain loop member 90 can travel directly from the sprocket 86 or 88 into the guide channel without interference.

It will be noted that a rolling door constructed in accordance with the invention is relatively easy to restore to an operating condition if it is struck or otherwise caused to come out of its guide channels. In this event, the hinged portion of each guide channel is opened up so as to gain access Lo the chain loop members and the adjusting mechanisms. The bottom bar 66 is restored to its original condition (or replaced if necessary) and then the finger 80 at one end of the bottom bar is inserted in its respective slot in the tab 100. For this purpose, it is not necessary to disconnect one of the end plates 74, 76, that is the end plate that is attached first. The other end plate is detached from the bottom bar by removal of the necessary bolts and is inserted into its respective slot in the other connecting tab 100. This end plate is then reconnected to the bottom bar in order to complete the operation. The whole operation can be carried out with relatively unskilled personnel following simple instructions.

An optional feature of the present rolling door assembly is a travelling wind bar 140, illustrated at least in part in FIG. 1. This wind bar moves up and down the flexible curtain by means of a wind bar strap 142 of known construction. Although the use of such a travelling wind bar is not essential to the operation of the present rolling door assembly, it is advantageous in that it improves the appearance of the flexible door. It also helps to maintain the side edges to the curtain in the guide channels. particularly in the case of wide doors.

It will be clear to those skilled in the construction of rolling doors that various modifications and changes can be made to the rolling door assembly described herein without departing from the spirit and scope of this invention. Accordingly all such modifications and changes as fall within the scope the appending claims are intended to be part of this invention.

We claim:

1. A rolling door assembly comprising:

a flexible curtain having an inner end, an outer end and side edges;

a rotatable curtain roll for mounting horizontally above a door opening, said inner end of said curtain being mounted to said curtain roll;

a curtain winding and unwinding mechanism, said curtain mechanism comprising a curtain sprocket mounted to said curtain roll and primary drive means to rotatingly drive said curtain sprocket:

secondary drive means in the form of a long flexible member operatively connected to said outer end of said curtain for movement therewith and operatively connected to said curtain roll so as to be driven thereby; and adjusting means connected between said outer end of said curtain and said secondary drive means to accommodate a difference in speed of travel between said secondary drive means and said outer end of said curtain, the outer end of said curtain moving at a variable speed as the curtain is wound up or unwound, wherein said adjusting means includes a coil spring arranged vertically, a tubular housing containing said coil spring, and a piston member slidable in said housing and engaging one end of said coil spring, and wherein said coil spring is compressed or expands to accommodate said difference in speed of travel as the curtain is unwound or wound up.

2. An assembly according to claim 1 wherein said piston member has a tab extending outwardly therefrom and through a slot in said housing and said outer end of said curtain is connected to the tab.

3. An assembly according to claim 1 wherein said housing is connected directly to said long flexible member and is supported thereby.

4. An assembly according to claim 1 wherein there are two secondary drive means and two adjusting means, one of each of said secondary drive means and said adjusting means being located at each side edge of said curtain.

5. An assembly according to claim 1 including a pair of generally parallel, spaced apart guide channels, said side edges being received in said guide channels for travel therein.

6. An assembly according to claim 1 including a pair of generally parallel, spaced apart guide channels, said side edges and said adjusting means being received in said guide channels for travel therein, wherein said secondary drive means, except for upper end portions thereof, are located in both of said guide channels and extend substantially the entire length thereof.

7. An assembly according to claim 2 wherein said curtain is made of a thin fabric material having a maximum thickness no greater than ¼ inch.

8. An assembly according to claim 1 wherein said curtain is made of a vinyl sheet material having a maximum thickness no greater than ¼ inch.

9. A rolling door assembly comprising:

a door shaft for mounting horizontally above a door opening, a flexible curtain having a top end and a bottom end, said top end being connected to said door shaft, an endless drive loop member in operable engagement with said door shaft for loop travel during rotation of said door shaft, said bottom end of said curtain being secured to said drive loop member such that said bottom end and said drive loop member travel together.

an operating mechanism to rotate said door shaft in either direction in order to wind and unwind said curtain, and adjusting means connected between said bottom end of said curtain at one point and said drive loop member at another point to accommodate a difference in speed of travel between said drive loop member and said bottom end of said curtain, the bottom end of said curtain moving at a variable speed as the curtain is wound up or unwound, wherein said adjusting means includes a coil spring arranged vertically, said coil spring being compressed to accommodate said difference in speed of travel as said curtain is unwound and expanding as said curtain is wound up, a tubular housing containing said coil spring, a piston member slidable in said housing and engaging one end of said coil spring, and means for attaching the bottom end of said curtain to said piston member.

10. An assembly according to claim 9 wherein there are two drive loop members located at opposite side edges of said curtain and two adjusting means located on opposite sides of said curtain at said bottom end and wherein each drive loop member is a flexible drive chain that extends around a drive sprocket mounted on said door shaft.

11. An assembly according to claim 9 wherein said drive loop member is a chain that extends around a sprocket mounted on said door shaft the diameter of said sprocket being equal approximately to the diameter of said curtain when the curtain is fully wound on said door shaft.

12. An assembly according to claim 9 wherein said bottom end of said curtain is provided with a rigid bottom bar extending the width of the curtain and said bottom bar is releasably connected by said attaching means to said piston member.

13. An assembly according to claim 9 including a pair of generally parallel, spaced apart guide channels, side edges of said curtain and said adjusting means being received in both said guide channels, wherein there are two of said drive loop members and at least a substantial portion of each drive loop member is located in a respective one of said guide channels.

14. An assembly according to claim 9 wherein said curtain has substantially uniform thickness of about $\frac{1}{8}$ inch or less.

15. A rolling door assembly comprising:

a flexible curtain having an inner end, an outer end and side edges;

a curtain winding and unwinding mechanism;

a rotatable curtain roll adapted for horizontal placement across a top of a door opening, said inner end of said curtain being mounted on said curtain roll and winding and unwinding mechanism being connected thereto for rotary drive of said roll;

a rigid bottom bar extending the width of said curtain and connected to said outer end thereof;

two endless flexible loop members located at opposite side edges of said curtain operatively connected to said curtain roll for maintaining a tensile force on said curtain in the lengthwise direction thereof as said curtain is wound up or unwound, and;

two adjusting mechanisms connected between said bottom bar of said curtain at one point and said loop members at another point to accommodate a difference in speed of movement between said loop members and said outer end of said curtain, the outer end of said curtain moving at a variable speed as the curtain is wound up or unwound;

wherein each adjusting mechanism includes a coil spring extending vertically in a tubular housing which is connected to a respective one of said loop members and is supported thereby, said coil spring is compressed to accommodate said difference in speed of movement as said curtain is unwound, and said coil spring expands as said curtain is wound up;

wherein said bottom bar is releasably connected to each adjusting mechanism.

16. An assembly according to claim 15 including a pair of generally parallel, spaced apart guide channels, said side edges and said adjusting mechanism being received in said guide channels for travel therein.

* * * * *